US012410372B2

(12) United States Patent
Ramaseshan et al.

(10) Patent No.: US 12,410,372 B2
(45) Date of Patent: Sep. 9, 2025

(54) PROCESS SCHEME FOR MAXIMUM HEAVY OIL CONVERSION WITH STAGE ASPHALTENE REJECTION

(71) Applicant: SAUDI ARABIAN OIL COMPANY, Dhahran (SA)

(72) Inventors: Vinod Ramaseshan, Dhahran (SA); Emad Al Subaie, Dhahran (SA); Hector Infante, Dhahran (SA); Jesse Williams, Dhahran (SA); Rustam Ismagilov, Dhahran (SA); Abdalaziz A. Al-Balawi, Dhahran (SA); Ashok Kumar Choudhary, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 366 days.

(21) Appl. No.: 18/069,556

(22) Filed: Dec. 21, 2022

(65) Prior Publication Data

US 2023/0193145 A1 Jun. 22, 2023

Related U.S. Application Data

(60) Provisional application No. 63/265,872, filed on Dec. 22, 2021.

(51) Int. Cl.
*C10G 67/04* (2006.01)
*C10C 3/04* (2006.01)
(Continued)

(52) U.S. Cl.
CPC ..... *C10G 67/049* (2013.01); *C10C 3/04* (2013.01); *C10C 3/08* (2013.01); *C10C 3/14* (2013.01);
(Continued)

(58) Field of Classification Search
CPC ..... C10G 67/049; C10G 7/06; C10G 21/003; C10G 47/00; C10G 49/00; C10G 67/16;
(Continued)

(56) References Cited

U.S. PATENT DOCUMENTS

2019/0016965 A1* 1/2019 Aldous ..... C10G 21/003

FOREIGN PATENT DOCUMENTS

FR 3098824 A1 1/2021

OTHER PUBLICATIONS

International Search Report and Written Opinion issued in the corresponding International Application No. PCT/US2022/053795, mailed Mar. 29, 2023 (28 pages).

* cited by examiner

*Primary Examiner* — Prem C Singh
*Assistant Examiner* — Juan C Valencia
(74) *Attorney, Agent, or Firm* — Osha Bergman Watanabe & Burton LLP

(57) ABSTRACT

Provided is a system to upgrade an input stream of a straight run vacuum residue or a cracked feedstock that includes a vacuum column, a hydrocracking unit, a high lift solvent deasphalting unit, a low lift solvent deasphalting unit, and a bitumen blowing unit or a pitch pelletizing unit, and optionally a hydrotreating reactor. The system and components thereof may pass a distillate and naphtha product, a light ends product, an asphaltene-lean heavy deasphalted oil stream, an asphaltene-rich pitch stream, a light deasphalted oil that is a lube base feed stock, a heavy oil stream, a bitumen and asphalt stream or a solid fuel. Further provided is a process, including introducing a straight run vacuum residue or a cracked feed stock into a system, and operating the system including a step of fractionating, a step of solvent stage deasphalting, and a step of hydrocracking.

33 Claims, 3 Drawing Sheets

(51) Int. Cl.

| | |
|---|---|
| ***C10C 3/08*** | (2006.01) |
| ***C10C 3/14*** | (2006.01) |
| ***C10G 7/06*** | (2006.01) |
| ***C10G 21/00*** | (2006.01) |
| ***C10G 47/00*** | (2006.01) |
| ***C10G 49/00*** | (2006.01) |
| ***C10G 67/16*** | (2006.01) |

(52) U.S. Cl.
CPC ..... *C10G 7/06* (2013.01); *C10G 21/003* (2013.01); *C10G 47/00* (2013.01); *C10G 49/00* (2013.01); *C10G 67/16* (2013.01); *C10G 2300/1077* (2013.01); *C10G 2300/301* (2013.01); *C10G 2300/302* (2013.01); *C10G 2300/44* (2013.01)

(58) Field of Classification Search
CPC ..... C10G 2300/1077; C10G 2300/301; C10G 2300/302; C10G 2300/44; C10G 21/14; C10G 55/04; C10G 67/0463; C10G 2300/206; C10C 3/04; C10C 3/08; C10C 3/14
See application file for complete search history.

PROCESS SCHEME FOR MAXIMUM HEAVY OIL CONVERSION WITH STAGE ASPHALTENE REJECTION

CROSS-REFERENCE TO RELATED APPLICATIONS

This application claims the benefit of U.S. patent application Ser. No. 63/265,872, which was filed on Dec. 22, 2021, and is incorporated herein by reference.

BACKGROUND

Refinery residuum are often blended with cutter stocks to produce transportable and marketable fuel oil. Some refineries may incorporate thermal cracking technology to produce fuel oil.

Common thermal cracking technology platforms may include both visbreaking and thermal cracking units. The fuel oil produced from these operations result in what is known as 'cracked fuel oil'. While straight run residues (that is, not cracked) are also used to produce fuel oil, they may be co-mingled or mixed with cracked fuel oil.

SUMMARY

This Summary is provided to introduce a selection of concepts that are further described in the Detailed Description. This Summary is not intended to identify key or essential features of the claimed subject matter, nor is it intended to be used as an aid in limiting the scope of the claimed subject matter.

In one aspect, one or more embodiments disclosed relate to a system to upgrade an input stream that may comprise a vacuum column, a hydrocracking unit coupled downstream of and in fluid communication with the vacuum column, a high lift solvent deasphalting unit coupled downstream of and in fluid communication with the vacuum column, a low lift solvent deasphalting unit coupled downstream of and in fluid communication with the vacuum column, and a bitumen blowing unit coupled downstream of and in fluid communication with the vacuum column and the high lift solvent deasphalting unit. The vacuum column may be configured to receive an input stream of a straight run vacuum residue or a cracked feedstock and to separate the input stream into a vacuum column light stream and a vacuum residue stream. The hydrocracking unit may be configured to receive a combined stream of the vacuum column light stream and a heavy deasphalted oil stream, as well as a hydrogen stream, and to pass a distillate and naphtha product, and a light ends product. The heavy deasphalted oil stream may be in fluid communication with the hydrocracking unit and also with the high lift solvent deasphalting unit. The high lift solvent deasphalting unit may be configured to receive a butane stream, as well as a combined stream that may comprise a first portion of the vacuum residue stream, a first portion of a hydrocracking bleed stream, and a heavy oil stream, and to pass an asphaltene-lean heavy deasphalted oil stream and an asphaltene-rich pitch stream. The unconverted oil stream may be in fluid communication with the hydrocracking unit, the high lift solvent deasphalting unit, and the bitumen blowing unit. The low lift solvent deasphalting unit may be configured to receive a propane stream, as well as a second portion of the vacuum residue stream, and to pass a light deasphalted oil that may be a lube base feed stock, and a heavy oil stream. The heavy oil stream may be in fluid communication with the high lift solvent deasphalting unit. The bitumen blowing unit may be configured to receive a combined stream of a second portion of the hydrocracking bleed stream, a remaining portion of the vacuum residue stream, and a low viscosity gas oil stream, and to pass a bitumen and asphalt stream. The low viscosity gas oil stream may be in fluid communication with the bitumen blowing unit. The vacuum residue stream may be in parallel to the high lift solvent deasphalting unit, the low lift solvent deasphalting unit, and the bitumen blowing unit.

In another aspect, one or more embodiments disclosed relate to a system to upgrade an input stream that may comprise an input stream of a straight run vacuum residue or a cracked feedstock, a vacuum column, a hydrocracking unit coupled downstream of and in fluid communication with the vacuum column, a high lift solvent deasphalting unit coupled downstream of and in fluid communication with the vacuum column, a low lift solvent deasphalting unit coupled downstream of and in fluid communication with the vacuum column, and a pitch pelletizing unit coupled downstream of and in fluid communication with the high lift solvent deasphalting unit. The vacuum column may be configured to receive the input stream and to separate the input stream into a vacuum column light stream and a vacuum residue stream. The hydrocracking unit may be configured to receive a combined stream of the vacuum column light stream and a heavy deasphalted oil stream, as well as a hydrogen stream, and to pass a distillate and naphtha product, and a light ends product. The heavy deasphalted oil stream may be in fluid communication with the hydrocracking unit and also with the high lift solvent deasphalting unit. The high lift solvent deasphalting unit may be configured to receive a butane stream, as well as a combined stream of a first portion of the vacuum residue stream, an unconverted oil stream as a hydrocracking bleed stream, and a heavy oil stream, and to pass an asphaltene-lean heavy deasphalted oil stream and an asphaltene-rich pitch stream. The unconverted oil stream may be in fluid communication with the hydrocracking unit and the high lift solvent deasphalting unit. The low lift solvent deasphalting unit may be configured to receive a propane stream, as well as a combined stream of a second portion of the vacuum residue stream, and to pass a light deasphalted oil that is a lube base feed stock, and a heavy oil stream. The heavy oil stream may be in fluid communication with the high lift solvent deasphalting unit. The pitch pelletizing unit may be configured to receive an asphaltene-rich pitch stream, and to pass a solid fuel. The asphaltene-rich pitch stream may be in fluid communication with the high lift solvent deasphalting unit and the pitch pelletizing unit. The vacuum residue stream may be in parallel to the high lift solvent deasphalting unit and the low lift solvent deasphalting unit.

In another aspect, one or more embodiments disclosed relate to a system to upgrade an input stream that may comprise an input stream of a straight run vacuum residue or a cracked feedstock, a vacuum column, a hydrocracking unit coupled downstream of and in fluid communication with the vacuum column, a high lift solvent deasphalting unit coupled downstream of and in fluid communication with the vacuum column, a low lift solvent deasphalting unit coupled downstream of and in fluid communication with the high lift solvent deasphalting unit, a hydrotreating reactor coupled downstream of and in fluid communication with the high lift solvent deasphalting unit and the low lift solvent deasphalting unit, and a bitumen blowing unit coupled downstream of and in fluid communication with the vacuum column and the high lift solvent deasphalting unit. The vacuum column may be configured to receive the input stream and to separate the input stream into a vacuum column light stream and a vacuum residue stream. The hydrocracking unit may be configured to receive a hydrogen stream, as well as a combined stream of the vacuum column light stream and an effluent from the hydrotreating reactor, and to pass a distillate and naphtha product, and a light ends product. The effluent from the hydrotreating reactor may be in fluid communication with the hydrocracking unit as an effluent hydrocracking feed stream and may also be in fluid communication with the hydrotreating reactor. The high lift solvent deasphalting unit may be configured to receive a butane stream, as well as a combined stream of a first portion of the vacuum residue stream, and a first portion of a hydrocracking bleed stream, and to pass an asphaltene-lean heavy deasphalted oil stream and an asphaltene-rich pitch stream. The unconverted oil stream may be in fluid communication with the hydrocracking unit, the high lift solvent deasphalting unit, and the bitumen blowing unit. The low lift solvent deasphalting unit may be configured to receive a propane stream, as well as a first portion of the asphaltene-lean heavy deasphalted oil stream, and to pass a light deasphalted oil that is a lube base feed stock, and a heavy oil stream. The heavy oil stream may be in fluid communication with the hydrotreating reactor. The hydrotreating reactor may be configured to receive a hydrogen stream, as well as a combined stream of a second portion of the asphaltene-lean heavy deasphalted oil stream, and the heavy oil stream, and to pass a light ends product. The bitumen blowing unit may be configured to receive a combined stream of a second portion of the hydrocracking bleed stream, a second portion of the vacuum residue stream, the asphaltene-rich pitch stream, and a low viscosity gas oil stream, and to pass a bitumen and asphalt stream. The low viscosity gas oil stream may be in fluid communication with the bitumen blowing unit. The vacuum residue stream may be in parallel to the high lift solvent deasphalting unit and the bitumen blowing unit.

In yet another aspect, one or more embodiments disclosed relate to a process, that may comprise introducing a straight run vacuum residue or a cracked feed stock into a system, and operating the system including a step of fractionating, a step of solvent stage deasphalting, and a step of hydrocracking. The step of fractionating may include operating the system such that a fractionated distillate, a gas oil product, and a vacuum residue are produced from a vacuum column with an input of the straight run vacuum residue or the cracked feed stock, and combining the fractionated distillate and the gas oil product into a single internal stream as a vacuum column lights stream. The step of solvent stage deasphalting may include operating the system such that an asphaltene-lean heavy deasphalted oil and an asphaltene-rich pitch are produced from a high-lift solvent deasphalting unit with an input of a combined internal stream of vacuum residue and unconverted oil. The step of solvent stage deasphalting may further include operating the system such that a light deasphalted oil, which is a lube base feed stock, and a heavy oil are produced from a low-lift solvent deasphalting unit with an input of vacuum residue or an asphaltene-lean heavy deasphalted oil. The step of hydrocracking may include operating the system such that a naphtha product and an unconverted oil are produced from a hydrocracking unit with an input of a combined internal stream of a vacuum residue and an asphaltene-lean heavy deasphalted oil.

Other aspects and advantages of the claimed subject matter will be apparent from the following Detailed Description and the appended Claims.

DETAILED DESCRIPTION

Figure 1:
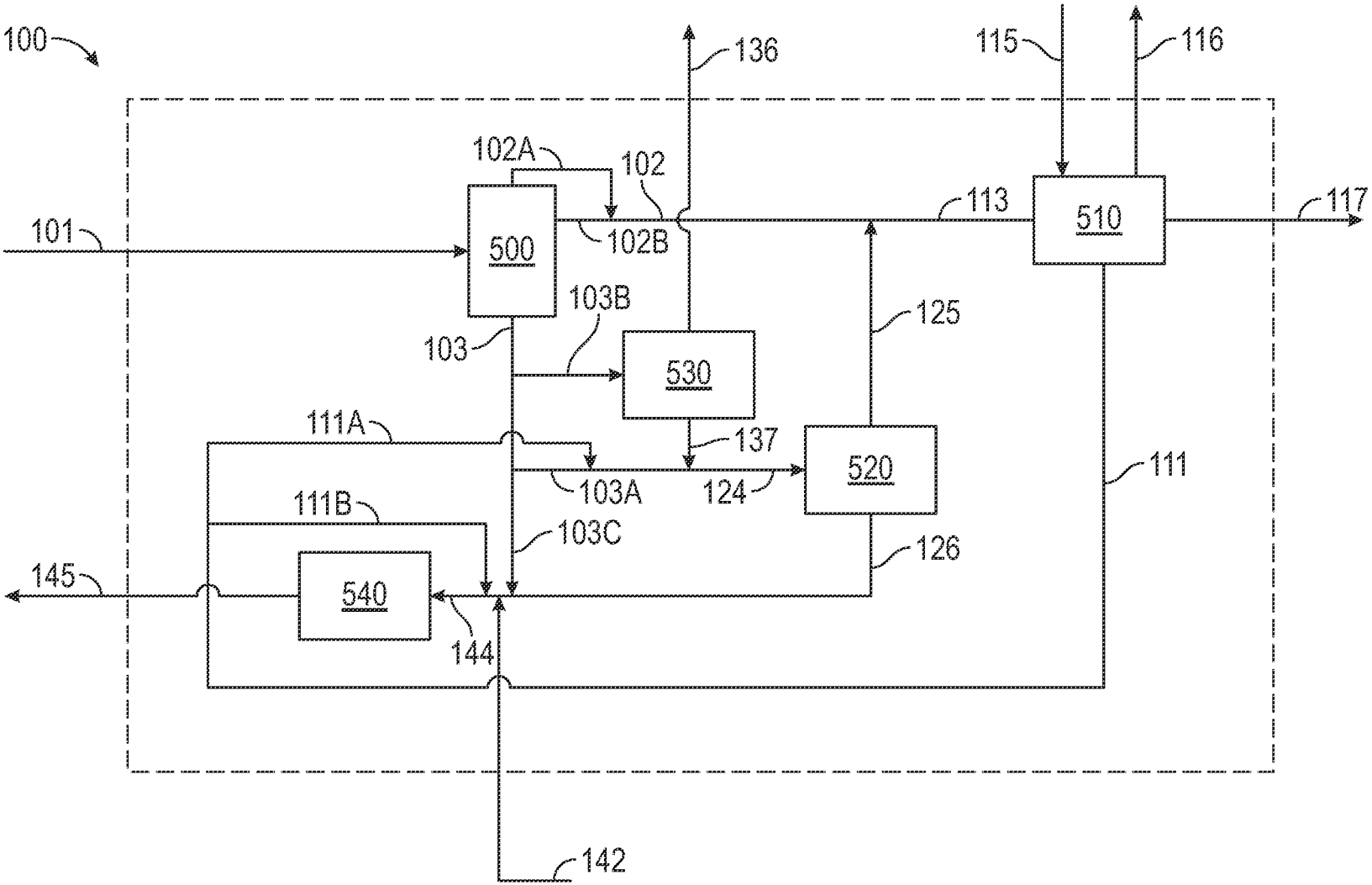
FIG. 1 shows a system that is a parallel solvent deasphalting residuum upgrading complex with bitumen production, according to one or more embodiments.

One or more embodiments relates to a system and a process for oil separation and upgrading. Specifically, the system is used for converting residue into fuel and petrochemical feedstock.

One or more embodiments of the disclosure relate to a heavy oil conversion process. The process may convert vacuum residue streams into fuels (such as diesel, gasoline, and naphtha); lube base feed stock; olefins, such as ethylene, propylene; and aromatics, such as butylenes, benzene, toluene, and xylenes.

The system for oil separation and upgrading includes an input stream comprising residue, a vacuum column, a vacuum column light stream (distillate and gas oil), a vacuum residue stream, a hydrocracking unit, a high lift solvent deasphalting unit, a low lift solvent deasphalting unit, and a bitumen blowing unit in one or more embodiments.

The process includes fractionation and stage solvent deasphalting. Stage solvent deasphalting may also be called staged asphaltene rejection. In one or more embodiments, asphaltene rejection of vacuum residue is allowed through stage solvent deasphalting. Produced deasphalted oil in one or more embodiments is processed through hydrocracking or fluid catalytic cracking units. For example, rejected heavy pitch from the solvent deasphalting stage may be upgraded to bitumen or used as fuel for gasification.

The system may include a vacuum column, a hydrocracking unit, a high lift solvent deasphalting unit, and a low lift solvent deasphalting unit. The system may further include a bitumen blowing unit or a pitch pelletizing unit. The bitumen blowing unit is configured to receive vacuum residue, so it may be called a vacuum residue bitumen blowing unit.

The products that are produced from the hydrocracking unit, low lift solvent deasphalting unit, and bitumen blowing unit may become fuel products, such as white oil, lube base feed stock, petrochemical feedstock, and combination thereof.

An input stream is introduced into the vacuum column. The input stream may be a straight run atmospheric residue or a cracked feedstock. The vacuum column is configured to receive the input stream and to separate the input stream into a vacuum column light stream (gas oil) and a vacuum residue stream (a bottoms stream). The vacuum column light stream includes material boiling nominally less than 560° C. true boiling point (TBP).

The hydrocracking unit is coupled downstream of and in fluid communication with the vacuum column. The hydrocracking unit and is configured to treat the vacuum column light stream and a heavy oil stream from the high-lift solvent deasphalting unit with hydrogen and a catalyst. The hydrocracking unit converts the gasoil, distillate, and heavy deasphalted oil into high value fuels products, such as naphtha, distillate, and "light ends", such as liquified petroleum gases (LPG) and natural gases. The hydrocracking unit is configured to pass a distillate and naphtha product and a light ends product. As well, the hydrocracking unit is configured to pass an unconverted oil stream called the hydrocracking bleed stream. The unconverted oil (reject) stream is passed to the bitumen blowing unit.

The high lift solvent deasphalting unit is coupled downstream of and in fluid communication with the vacuum column and the low lift solvent deasphalting unit. The high lift solvent deasphalting unit is in fluid communication with the hydrocracking unit. The high lift solvent deasphalting unit is configured to produce an asphaltene-lean heavy deasphalted oil and an asphaltene-rich pitch.

The low lift solvent deasphalting unit produces a light deasphalted oil, which is a lube base feed stock, and a heavy oil stream. The heavy oil stream is passed to the high lift solvent deasphalting unit.

The bitumen blowing unit is coupled downstream of and in fluid communication with the vacuum column and the high lift solvent deasphalting unit. In one or more embodiments, the bitumen blowing unit is coupled downstream of and in fluid communication with the vacuum column, the high lift solvent deasphalting unit, and the hydrocracking unit. The high lift solvent deasphalting unit (bottoms) pitch may be blended with a small amount of light reject fuel streams produced with the complex and blown with air. The small amount of light reject fuel streams is from about 3 to about 10% of the fresh feed rate to the vacuum column. The bitumen blowing unit produces bitumen and asphalt that may be road/paving asphalt.

The pitch pelletizing unit produces pelletized or flaked pitch that may be used as a solid fuel.

In one or more embodiments, hydrotreating with a fluid catalytic cracking unit replaces the hydrocracking unit.

In one or more embodiments, when asphalt cannot be produced, the pitch may be disposed as fuel to a boiler or a partial oxidation unit.

One or more embodiments relate to a parallel solvent deasphalting residuum upgrading complex with bitumen production.

One or more embodiments relate to a parallel solvent deasphalting residuum upgrading complex without bitumen production.

One or more embodiments relate to a solvent deasphalting cracked stock residuum upgrading complex with bitumen production.

Parallel Solvent Deasphalting Residuum Upgrading Complex with Bitumen Production FIG. 1 shows a system that is a parallel solvent deasphalting residuum upgrading complex with bitumen production. System 100 is a residuum upgrading complex with parallel solvent deasphalting with bitumen production. This means that the high lift solvent deasphalting unit and the low lift solvent deasphalting unit have parallel inputs of vacuum residue originating from a single source. In one or more embodiments, the bitumen blowing unit also has a parallel input of vacuum residue from the same source.

System 100 has several feed and product streams. Input stream 101 is introduced into vacuum column 500 and comprises hydrocarbons with a true boiling point (TBP) of greater than 370° C. Input stream 101 may be an input refinery residuum including, but not limited to, atmospheric residue oil produced from a crude distillation unit with a TBP greater than 370° C. Hydrogen feed stream 115 is introduced into hydrocracking unit 510 and consists of hydrogen. A low viscosity gas oil stream 142 is combined with other streams into bitumen blowing unit feed stream 144. The low viscosity gas oil stream may have a TBP in the range of from about 300° C. to about 450° C. and may have a viscosity of from about 3 centistokes (cSt) to about 8 cSt. The low viscosity gas oil stream 142 is such that bitumen blowing unit feed stream 144 (combined stream) may have a viscosity in a range of from about 800 cSt to about 1200 cSt. The bitumen blowing unit feed stream 144 may comprise about 50 wt % vacuum residue (from vacuum residue stream 103C), about 30 wt % pitch (from asphaltene-rich pitch stream 126), and the remainder from low viscosity gas oil stream 142 and hydrocracking bleed stream 111B. Hydrocracking bleed stream 111B may have from about 2 wt % to about 20 wt % of gas oil as compared to the total bitumen blowing unit feed stream 144.

Light ends stream 116 is produced as light gases and lights from hydrocracking. The light ends stream may have saturates in addition to an olefin content of less than about 2%. Light ends stream 116 passes from hydrocracking unit 510 and includes any excess hydrogen from the operation of the hydrocracking unit.

A combined distillate and naphtha product stream 117 passes from hydrocracking unit 510. The combined distillate and naphtha product stream comprises fuel or petrochemical feed stocks.

Light deasphalted oil product stream 136 passes from the low lift solvent deasphalting unit 530. Light deasphalted oil product stream comprises a light deasphalted oil that may be a lube base feed stock that can be used to make, for example, bright oil.

Bitumen and asphalt stream 145 passes from bitumen blowing unit 540. Bitumen and asphalt stream 145 may comprise a roofing grade, a paving grade, a road grade asphalt (bitumen), or a combination thereof.

In the system 100, an input stream 101 is introduced into system 100 via vacuum column 500. In one or more embodiments, the configuration of the system 100 permits production of two products from the vacuum column 500: a vacuum column light stream 102, which is a combined stream of distillate stream 102A and vacuum gas oil stream 102B that comprises hydrocarbons that boil at TBP less than 560° C., and vacuum residue stream 103, which comprises hydrocarbons that boil at TBP greater than or equal to 560° C.

The distillate stream 102A comprises hydrocarbons that boil at TBP less than about 370° C., and the vacuum gas oil stream 102B comprises hydrocarbons that boil at TBP between about 370° C. and about 560° C.

The system 100 is configured such that the vacuum residue stream 103 passing from vacuum column 500 is proportionally divided into three parallel streams. A first portion of the vacuum residue stream 103A is directed to high lift solvent deasphalting unit 520 for processing. The first portion of the vacuum residue stream 103A is from about 40 wt % to about 60 wt %, such as from about 45 wt % to about 55 wt %. A second portion of the vacuum residue stream 103B is directed to the low lift solvent deasphalting unit 530 for processing. In one or more embodiments, the second portion of the vacuum residue stream 103B is about 5 wt % to about 15 wt %, such as about 8 wt % to about 12 wt %, of the vacuum residue stream 103 and is passed to the low lift solvent deasphalting unit. The remaining portion of the vacuum residue stream 103C is directed to the bitumen blowing unit 540 for processing, such as from about 25 wt % to about 45 wt %, or from about 35 wt % to about 45 wt %. The remaining portion of the vacuum residue stream 103C is introduced into bitumen blowing unit feed stream 144, which is introduced into the bitumen blowing unit 540.

The vacuum residue stream 103 that is divided into three parallel streams may be advantageous when feed quality is poor compared to streams that are in series. Without wanting to be bound by theory, the parallel stream configuration allows deasphalted oil (DAO) to maintain a sufficient quality to feed a fixed bed catalytic unit. In contrast, a series stream configuration would likely require a residue hydrotreater with fluid catalytic cracking (FCC), which results in limited processing options.

System 100 is configured such that the second portion of the vacuum residue stream 103B may pass to the low lift solvent deasphalting unit 530. The low lift solvent deasphalting unit 530 is configured to combine the second portion of the vacuum residue stream with a propane stream (as a solvent, not shown) to separate the second portion of the vacuum residue stream into two products. The ratio of solvent to vacuum residue feed may be in a ratio of from about 6:1 to about 8:1 in one or more embodiments. The low lift solvent deasphalting unit 530 provides a lift of 40% or less, such as less than 40%, less than about 35, less than about 30%, or less than 30%. In one or more embodiments, the low lift solvent deasphalting unit 530 provides a non-zero lift, meaning that the lift is not 0%.

The system 100 is configured such that the low lift solvent deasphalting unit 530 may produce two product streams: a light deasphalted oil product stream 136, which passes from the system 100 as a product, and a heavy oil stream 137 that may pass from the bottom as a reject stream. The produced light deasphalted oil is a lube base feed stock that is cleaner than deasphalted oil. The produced light deasphalted oil may include metals at less than 1.5 ppm (part-per-million) of the light deasphalted oil product stream 136 and a viscosity less than 35 cSt (centistokes) to meet group I base stock bright stock quality, which is appreciated by one of ordinary skill in the art.

The configuration of system 100 is such that the vacuum column light stream 102 may pass towards hydrocracking unit 510. An asphaltene-lean heavy deasphalted oil stream 125 from the high lift solvent deasphalting unit 520 may combine with vacuum column light stream 102 to form hydrocracking feed stream 113. In addition, a hydrogen feed stream 115 consisting of hydrogen is introduced into the hydrocracking unit 510. The hydrocracking unit includes a fixed bed catalyst, to be described. The feed to the hydrocracking unit 510 may be limited by the amount of heavy deasphalted oil as a component. The heavy deasphalted oil may be no greater than 40 wt % of the feed or a high conversion hydrocracking unit, for example, a unit with 95% conversion or greater.

In one or more embodiments, the system 100 is configured such that the hydrocracking unit 510 may under hydrocracking conditions and in presence of excess hydrogen and a catalyst. The hydrocracking unit during operation is configured to convert the combined distillate, gas oil, and asphaltene-lean heavy deasphalted oil into distillate, naphtha, light ends, and reject material. In one or more embodiments, the operational temperature of the hydrocracking unit is in a range of from about 360° C. to 420° C. The operational pressure of the hydrocracking unit is in a range of from about 70 bar absolute (bara) to 170 bara (hydrogen partial pressure).

The hydrocracking unit 510 may also be configured to separate the products into several product streams. The light ends product and any excess may be configured such that distillate and naphtha products may pass from the hydrocracking unit 510 and system 100 as a combined distillate and naphtha product stream 117, where they may be further processed. The hydrocracking unit 510 may be further configured such that the light ends product and any excess hydrogen may pass from the hydrocracking unit 510 and from system 100 as light ends stream 116. The hydrocracking unit 510 may be further configured such that the rejected material from the hydrocracking unit 510 passes from the unit as hydrocracking bleed stream 111, which is a system recycle stream.

In one or more embodiments, the configuration for system 100 may be such that the hydrocracking unit 510 may be a catalytic cracking unit. The catalytic cracking unit may be a conventional riser fluid catalytic unit or a high catalyst-to-oil ratio downer design.

The system 100 is configured such that the hydrocracking bleed stream 111, comprising unconverted oil (or unconverted oil stream), is divided into two streams. A first portion of the hydrocracking bleed stream 111A, such as from about 80 wt % to 100 wt %, may pass to the high lift solvent deasphalting unit 520. The first portion of the hydrocracking bleed stream 111A may be combined with other streams into the high lift solvent deasphalting unit feed stream 124 before being introduced into high lift solvent deasphalting unit 520. The second portion of the hydrocracking bleed stream 111B, such as from greater than 0 wt % to about 20 wt %, may pass to the bitumen blowing unit 540 for further processing. The second portion of the hydrocracking bleed stream 111B may be combined with other streams into bitumen blowing unit feed stream 144 before being introduced into the bitumen blowing unit 540.

In the configuration of system 100, a number of streams may combine to become the high lift solvent deasphalting unit feed stream 124. In system 100, the first portion of the vacuum residue stream 103A may be combined with both the first portion of the hydrocracking bleed stream 111A and the heavy oil stream 137 from the low lift solvent deasphalting unit 530 to form high lift solvent deasphalting unit feed stream 124. The system 100 may be configured such that the high lift solvent deasphalting unit may be fed with a combination of vacuum residuum, asphalted heavy oil, and recycled material from hydrocracking unit.

The high lift solvent deasphalting unit may be considered the 'unit of last resort' in system 100 in that it may recycle useful fluid products back through the system 100. That is, the bottoms product from this unit is passed for conversion in the bitumen blowing process and is no longer available to recover useful materials for chemical processing. The system 100 may be configured such that the high lift solvent deasphalting unit feed stream 124 may be introduced into high lift solvent deasphalting unit 520. The system 100 may also be configured such that the high lift solvent deasphalting unit 520 may be processed with the combination of vacuum residue, unconverted oil, and heavy oil, in the presence of a butane solvent, into asphaltene lean and rich products. The high lift solvent deasphalting unit may be configured to receive a butane stream. The solvent (butane) to oil (the combined vacuum residue, unconverted oil, and heavy oil) ratio may be in a rage of from about 3:1 to about 8:1, such as from about 3:1 to about 7:1, from about 3:1 to about 6:1, from about 4:1 to about 8:1, from about 4:1 to about 7:1, or from about 4:1 to about 6:1. Butane (and propane where applicable, as a butane stream or a propane stream) are not shown in the figures. The extraction pressure of the solvent deasphalting unit(s), such as the high lift solvent deasphalting unit, are greater than the critical pressure of the solvents utilized in the solvent deasphalting unit(s).

The system 100 may be configured such that the high lift solvent deasphalting unit 520 may produce two products from the conversion of the high lift solvent deasphalting unit feed stream, both of which are provided to other units for additional processing. An asphaltene-lean heavy deasphalted oil stream 125 may be produced as the light product. As previously described, the asphaltene-lean heavy deasphalted oil stream 125 is combined with the vacuum column light stream 102 to form the hydrocracking feed stream 113. An asphaltene-rich pitch stream 126 may also be formed as the bottoms product. The asphaltene-rich pitch stream 126 is directed towards the bitumen blowing unit 540 for conversion.

In the configuration of system 100, a number of streams may combine to become the bitumen blowing unit feed stream 144. The remaining portion of the vacuum residue stream 103C (third portion) is combined with the asphaltene-rich pitch stream 126 from the high lift solvent deasphalting unit 520 and with the second portion of the hydrocracking bleed stream 111B. In addition, the low viscosity gas oil stream 142 is introduced to system 100 may also be combined with the three other streams to form the bitumen blowing unit feed stream 144. The blend ratio of remaining portion of the vacuum residue stream 103C to asphaltene-rich pitch stream 126 is such that 103C (mixture of vacuum residue) is greater 40%, asphaltene-rich pitch stream 126 (pitch) is less than 30%, and the remainder is gas oil cutter to maintain a viscosity for the bitumen blowing unit feed less than about 1200 centistokes (cSt).

The system 100 is configured such that the bitumen blowing unit feed stream 144 may be introduced into the bitumen blowing unit 540 and converted into a bitumen and asphalt product. The bitumen blowing unit is an air blowing unit where the hydrocarbon mixture (bitumen blowing unit feed stream 144) is heated to temperature range of from about 300° C. to about 500° C. and blown with air at a pressure of from about 1 bar to about 2 bar. The resultant bitumen and asphalt may be a road grade product. The bitumen and asphalt product may be passed from bitumen blowing unit 540 and system 100 via bitumen and asphalt stream 145.

Figure 2:
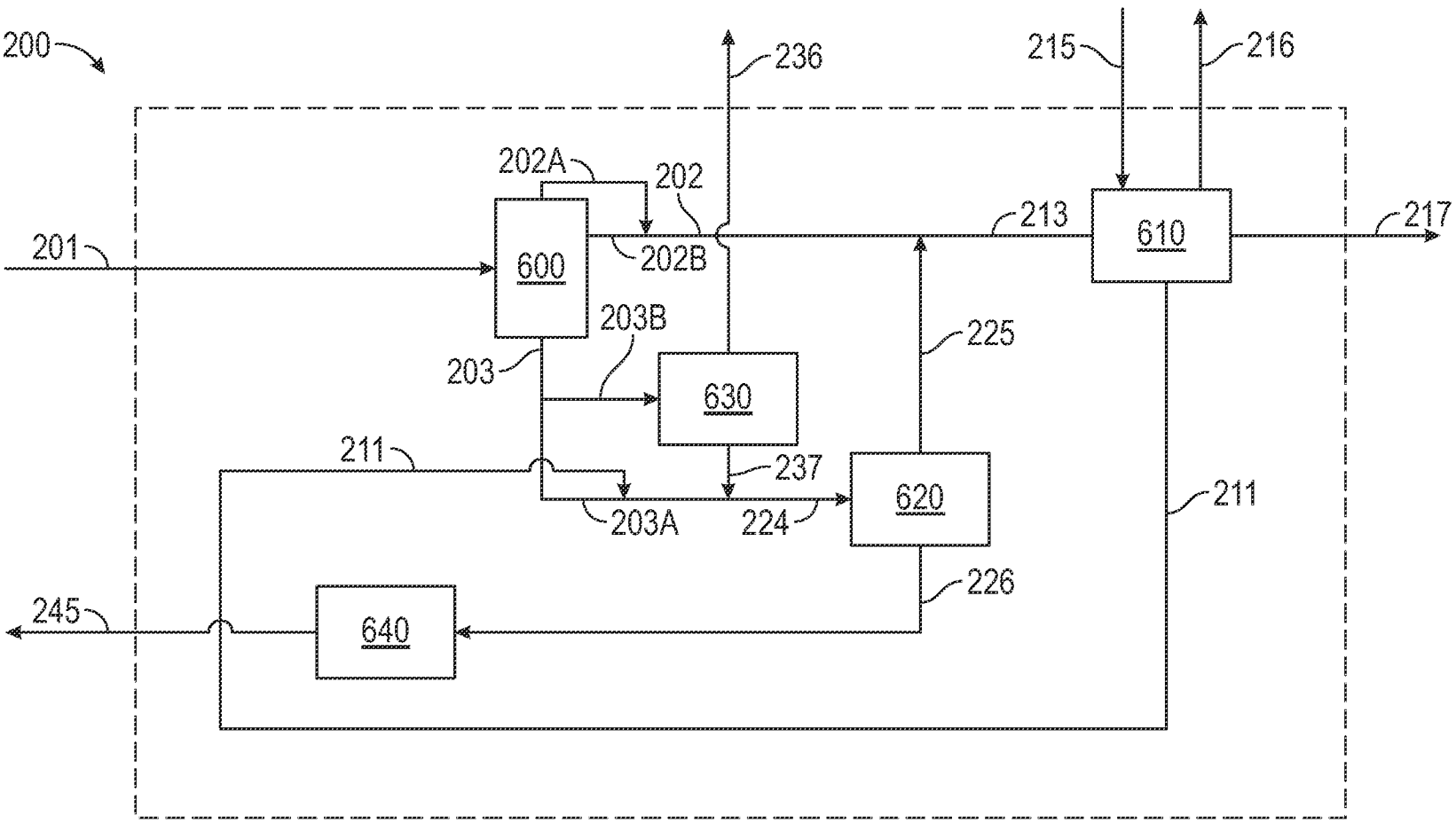
FIG. 2 shows a system that is a parallel solvent deasphalting residuum upgrading complex without bitumen production, according to one or more embodiments.

Parallel Solvent Deasphalting Residuum Upgrading Complex, without Bitumen Production FIG. 2 shows system that is a parallel solvent deasphalting residuum upgrading complex. System 200 is a residuum upgrading complex without bitumen production. This means that the high lift solvent deasphalting unit and the low lift solvent deasphalting unit have parallel input of vacuum residue originating from a single source.

System 200 has several feed and product streams. Input stream 201 is introduced into vacuum column 600 and comprises hydrocarbons with a TBP of greater than 370° C. Hydrogen feed stream 215 is introduced into hydrocracking unit 610 and consists of hydrogen. Light ends stream 216 passes from hydrocracking unit 510 and includes light gases and any excess hydrogen from the operation of the hydrocracking unit. A combined distillate and naphtha product stream 217 passes from hydrocracking unit 610 and comprises fuel or petrochemical feed stocks. Light deasphalted oil product stream 236 passes from the low lift solvent deasphalting unit 630 and comprises a light deasphalted oil which is a lube base feed stock that can be used to make bright oil. Solidified pitch stream 245 passes from pitch pelletizing unit 640 and comprises pelletized or flaked pitch, which may be used as a solid fuel.

In the system 200, an input stream 201 is introduced into system 200 via vacuum column 600. In one or more embodiments, the configuration of the system 200 permits the production of two products from the vacuum column 600: a vacuum column light stream 202, which is a combined stream of distillate stream 202A and vacuum gas oil stream 202B that comprises hydrocarbons that boil at TBP less than 560° C., and vacuum residue stream 203, which comprises hydrocarbons that boil at temperatures greater than or equal to TBP 560° C.

The distillate stream 202A comprises hydrocarbons that boil at TBP less than about 370° C., and the vacuum gas oil stream 202B comprises hydrocarbons that boil at TBP between about 370° C. and about 560° C.

The system 200 is configured such that the vacuum residue stream 203 passing from vacuum column 600 is proportionally divided into two parallel streams. A first portion of the vacuum residue stream 203A is directed to high lift solvent deasphalting unit 620 for processing. The first portion of the vacuum residue stream 203A may be from about 70 wt % to about 90 wt %, such as from about 75 wt % to about 85 wt %, of the vacuum residue stream 203 that is passed to the high lift solvent deasphalting unit. A second portion of the vacuum residue stream 203B is directed to the low lift solvent deasphalting unit 630 for processing. The second portion of the vacuum residue stream 203B may be from about 10 wt % to about 30 wt % of the vacuum residue stream 203 that is passed to the low lift solvent deasphalting unit, such as from about 15 wt % to about 25 wt %.

System 200 is configured such that the second portion of the vacuum residue stream 203B may pass to the low lift solvent deasphalting unit 630. The low lift solvent deasphalting unit 630 is configured to combine the second portion of the vacuum residue feed stream with a propane stream (as a solvent, not shown) to separate the second portion of the vacuum residue feed stream into two products. The ratio of the solvent to vacuum residue feed may be in a ratio of about 8:1 in one or more embodiments.

The system 200 is configured such that the low lift solvent deasphalting unit 630 may produce two product streams: a light deasphalted oil product stream 236, which passes from the system 200 as a product, and a heavy oil stream 237 that may pass from the bottom as a reject stream. The produced light deasphalted oil is a lube base feed stock.

The configuration of system 200 is such that the vacuum column light stream 202 may pass towards the hydrocracking unit 610. An asphaltene-lean heavy deasphalted oil stream 225 from the high lift solvent deasphalting unit 620 may be combined with the vacuum column light stream 202 to form hydrocracking feed stream 213. In addition, a hydrogen feed stream 215 consisting of hydrogen is introduced into the hydrocracking unit 610. The hydrocracking unit includes a fixed bed catalyst, to be described.

In one or more embodiments, the system 200 is configured such that the hydrocracking unit 610 may under hydrocracking conditions and in the presence of excess hydrogen and a catalyst convert the combined distillate, gas oil, and asphaltene-lean heavy deasphalted oil into distillate, naphtha, light ends, and reject material.

The hydrocracking unit 610 may also be configured to separate the products into several product streams. The system 200 may be configured operated such that the light ends product and any excess configured such that distillate and naphtha products may pass from the hydrocracking unit 610 and system 200 as a combined distillate and naphtha product stream 217, where they may be further processed. The hydrocracking unit 610 may be further configured such that the light ends product and any excess hydrogen may pass from the hydrocracking unit 610 and from system 200 as light ends stream 216, where they may be further processed. The hydrocracking unit 610 may be further configured such that the rejected material from the hydrocracking unit 610 passes from the unit as hydrocracking bleed stream 211, which is a system recycle stream.

In one or more embodiments, the configuration for system 200 may be such that the hydrocracking unit 610 may be a catalytic cracking unit. The catalytic cracking unit may be a conventional riser fluid catalytic unit or a high catalyst-to-oil ratio downer design.

The system 200 is configured such that the hydrocracking bleed stream 211 may pass to the high lift solvent deasphalting unit 620.

In the configuration of system 200, a number of streams may combine to become the high lift solvent deasphalting unit feed stream 224. In system 200, the first portion of the vacuum residue stream 203A may be combined with both the hydrocracking bleed stream 211 and the heavy oil stream 237 from the low lift solvent deasphalting unit 630 to form high lift solvent deasphalting unit feed stream 224. The system 200 may be combined such that the high lift solvent deasphalting unit may be fed with a combination of vacuum residuum, asphalted heavy oil, and recycled material from hydrocracking unit.

The high lift solvent deasphalting unit may be considered the "unit of last resort" in system 200 to recycle useful fluid products back into the system 200 and other units. That is, the bottoms product from this unit is passed for conversion in the pitch pelletizing process. The system 200 may be configured such that the high lift solvent deasphalting unit feed stream 224 may be introduced into high lift solvent deasphalting unit 620. The system 200 may also be configured such that the high lift solvent deasphalting unit 620 may process the combination of vacuum residue, unconverted oil, and heavy oil in the presence of a butane solvent into asphaltene rich and lean products. The solvent (butane) to oil (vacuum residue, unconverted, and heavy oil) ratio may be in a range of about 5:1 in one or more embodiments.

The system 200 may be configured such that the high lift solvent deasphalting unit 620 may produce two products from the conversion of the high lift solvent deasphalting unit feed stream, both of which are provided to other units for additional processing. An asphaltene-lean heavy deasphalted oil stream 225 may be produced as the light product. As previously described, the asphaltene-lean heavy deasphalted oil stream 225 is combined with the vacuum column light stream 202 to form the hydrocracking feed stream 213. An asphaltene-rich pitch stream 226 may be produced as the bottoms product. The asphaltene-rich pitch stream 226 is directed towards the pitch pelletizing unit 640 for conversion.

The system 200 may be configured such that the asphaltene-rich pitch stream 226 may be introduced into the pitch pelletizing unit 640 and converted into a pelletized or flaked pitch. The solidified pitch may be a solid fuel, for example, that may be used in a boiler or a partial oxidation unit. For example, solidified pitch may be used as fuel in a boiler to produce steam and the steam may be used in a facility to drive a steam turbine generator to create power. The solidified pitch may be partially oxidized to synthesis gas that may be used as a fuel, for example, in a gas turbine to produce power or steam, or used to create hydrogen. The pelletized or flaked pitch may be passed from the pitch pelletizing unit 640 and system 200 via solidified pitch stream 245.

Figure 3:
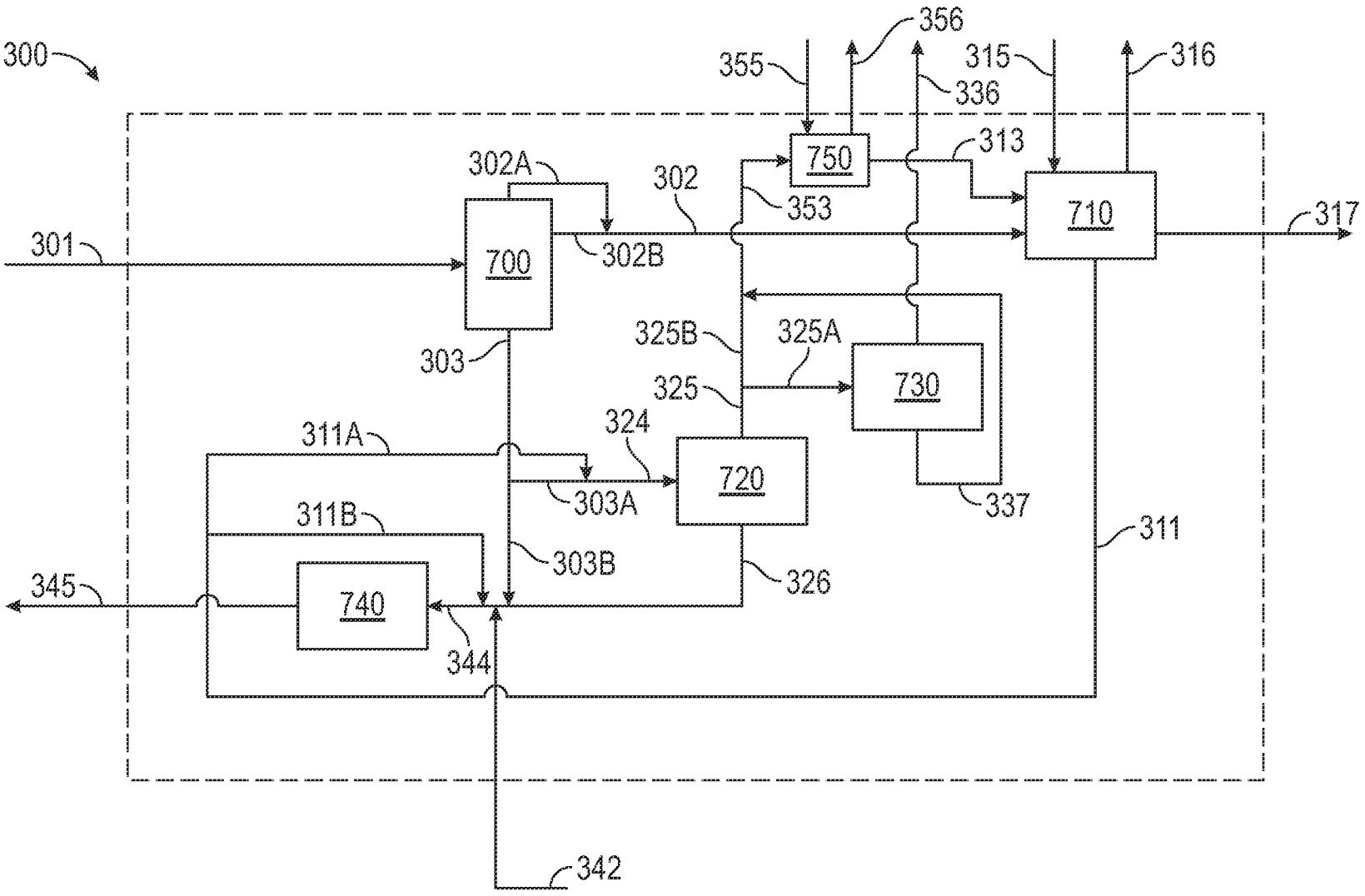
FIG. 3 shows a system that is a solvent deasphalting cracked stock residuum upgrading complex with bitumen production, according to one or more embodiments.

Solvent Deasphalting Cracked Stock Residuum Upgrading Complex, with Bitumen Production FIG. 3 shows a system that is a solvent deasphalting residuum upgrading complex with bitumen production. System 300 is a residuum upgrading complex with bitumen production. In system 300, the high lift solvent deasphalting unit and the bitumen blowing unit have parallel inputs of vacuum residue originates from a single source.

System 300 differs from system 100 and system 200 in part because system 300 may be a staged flow system, meaning that the solvent deasphalting units are in series (flow). The vacuum residue is first sent to a high lift solvent deasphalting unit and then a portion of the deasphalted oil is sent to the low lift solvent deasphalting unit. In system 300, there is a fixed bed residuum treatment (hydrotreating reactor 750) upstream of the hydrocracking unit 710. Thus, the quality of the deasphalted oil may be of poorer quality in system 300 compared to systems 100 or 200, and solvent deasphalting units in series flow may work (as the deasphalted oil quality in the conversion units are of poorer quality).

System 300 has several feed and product streams. Input stream 301 is introduced into vacuum column 700 and comprises hydrocarbons with a TBP of greater than 370° C. Hydrotreating hydrogen feed stream 355 is introduced into hydrotreating reactor 750 and consists of hydrogen. Hydrogen feed stream 315 is introduced into hydrocracking unit 710 and consists of hydrogen. A low viscosity gas oil stream 342 is combined with other streams into bitumen blowing unit feed stream 344. The low viscosity gas oil stream 342 is a stream of gas oil with a targeted viscosity in a range of from about 800 to 1200 cSt. Hydrotreated light ends stream 356 passes from the hydrotreating reactor 750 and includes a light ends product. Light ends stream 316 passes from hydrocracking unit 710 and includes light gases and any excess hydrogen from the operation of the hydrocracking unit. A combined distillate and naphtha product stream 317 passes from hydrocracking unit 710 and comprises fuel or petrochemical feed stocks. Light deasphalted oil product stream 336 passes from the low lift solvent deasphalting unit 730 and comprises deasphalted oil that may be a lube base feed stock that can be used to make, for example, bright oil. Bitumen and asphalt stream 345 passes from bitumen blowing unit 740 and may comprise a road grade asphalt.

In the system 300, an input stream 301 is introduced into system 300 via vacuum column 700. In one or more embodiments, the configuration of the system 300 permits production of two products from the vacuum column 700: a vacuum column light stream 302, which is a combined stream of distillate stream 302A and vacuum gas oil stream 302B of hydrocarbons that boil at temperatures less than 560° C., and vacuum residue stream 303, which includes hydrocarbons that boil at temperatures greater than or equal to 560° C.

The distillate stream 302A comprises hydrocarbons that boil at TBP less than about 370° C., and the vacuum gas oil stream 302B comprises hydrocarbons that boil at TBP between about 370° C. and about 560° C.

The system 300 is configured such that the vacuum residue stream 303 passing from vacuum column 700 is proportionally divided into two parallel streams. A first portion of the vacuum residue stream 303A is directed to the high lift solvent deasphalting unit 720 for processing. The first portion of the vacuum residue stream may be from about 50 wt % to about 80 wt %, such as from about 50 wt % to about 70 wt %, or from about 50 wt % to about 60 wt % of the vacuum residue stream 303. A second portion of the vacuum residue stream 303B is directed to the bitumen blowing unit 740 for processing. The second portion of the vacuum residue stream may be from about 20 wt % to about 50 wt %, such as from about 30 wt % to about 50 wt %, or from about 40 wt % to about 50 wt % of the vacuum residue stream 303. The second portion of the vacuum residue stream 303B is introduced into bitumen blowing unit feed stream 344, which is introduced into the bitumen blowing unit 740.

The configuration of system 300 is such that an asphaltene-lean heavy deasphalted oil stream 325 from the high lift solvent deasphalting unit 720 is split into two portions. The second portion of the asphaltene-lean heavy deasphalted oil stream 325B is combined with heavy oil stream 337 from the low lift solvent deasphalting unit 730 to form hydrotreating feed stream 353. In addition, a hydrotreating hydrogen feed stream 355 consisting of hydrogen is introduced into the hydrotreating reactor 750.

As mentioned, in system 300 configuration the hydrotreating feed stream 353 may be treated in the hydrotreating reactor 750. The combined lift between the low lift solvent deasphalting unit and the high lift solvent deasphalting unit is greater than 75%, such as 80% or greater, 85% or greater, 90% or greater, or 95% or greater. The lift over the high lift deasphalting unit alone is about 60% or more, such as 65% or greater, 70% or greater, 75% or greater, 80% or greater, 85% or greater, or 90% or greater. The hydrotreating feed stream 353 may have a high Conradson carbon value. The hydrotreating feed stream 353 may have organometallic contaminants. For example, metal content in the deasphalted oil may be greater than 10 parts-per-million (ppm) and Conradson carbon residue (value) in the feed may be greater than 8 ppm. Hydrotreatment may reduce these contaminants by utilizing excess hydrogen and a catalyst in the hydrotreating reactor.

In one or more embodiments, the system 300 is configured such that the hydrotreating reactor 750 hydrotreats the combined asphaltene-lean heavy deasphalted oil and a heavy oil and converts it into heavy hydrotreated effluent and light ends. The composition of the heavy hydrotreated effluent may include 85% or greater of the incoming heavy feed that remains (as material boiling about 370° C.) with metals and Conradson carbon ratio removed and the feed hydrotreated to a lower sulfur content (for example, 90% or greater desulfurization). There may be one or more product stream from hydrotreating reactor 750. The system 300 is further configured such that a hydrotreated light ends stream 356 may pass from the hydrotreating reactor 750 and system 300, where they may be further processed. The hydrotreating reactor 750 produces a light ends product. The effluent from the hydrotreating reactor, as effluent hydrocracking feed stream 313, is directed to the hydrocracking unit 710 for further processing.

The configuration of system 300 is such that the vacuum column light stream 302 may pass towards the hydrocracking unit 710. An effluent hydrocracking feed stream 313 from the hydrotreating reactor 750 may be combined with the vacuum column light stream 302 in the hydrocracking unit 710. In addition, a hydrogen feed stream 315 consisting of hydrogen is introduced into the hydrocracking unit 710. The hydrocracking unit includes a fixed bed catalyst, to be described.

In one or more embodiments, the system 100 is configured such that the hydrocracking unit 510 may under hydrocracking conditions and in presence of excess hydrogen and a catalyst convert the combined distillate, gas oil, and asphaltene-lean heavy deasphalted oil into distillate, naphtha, light ends, and reject material. In one or more embodiments, the operational temperature of the hydrocracking unit is in a range of from about 360° C. to 420° C. The operational pressure of the hydrocracking unit is in a range of from about 70 bar absolute (bara) to 170 bara (hydrogen partial pressure).

The hydrocracking unit 710 may also be configured to separate the products into several product streams. The system 300 may be configured operated such that the light ends product and any excess configured such that distillate and naphtha products may pass from the hydrocracking unit 710 and system 300 as a combined distillate and naphtha product stream 317, where they may be further processed. The hydrocracking unit 710 may be further configured such that the light ends product and any excess hydrogen may pass from the hydrocracking unit 710 and from system 300 as light ends stream 316, where they may be further processed. The hydrocracking unit 710 may be further configured such that the rejected material from the hydrocracking unit 710 passes from the unit as hydrocracking bleed stream 311, which is a system recycle stream.

In one or more embodiments, the configuration for system 300 may be such that the hydrocracking unit 710 may be replaced with a catalytic cracking unit. The catalytic cracking unit may be a conventional riser fluid catalytic unit or a high catalyst-to-oil ratio downer design.

The system 300 is configured such that hydrocracking bleed stream 311, comprising unconverted oil (or unconverted oil stream), is divided into two streams. A first portion of the hydrocracking bleed stream 311A, such as from about 80 wt % to 100 wt %, may pass to the high lift solvent deasphalting unit 720. The first portion of the hydrocracking bleed stream 311A may be combined with other streams into high lift solvent deasphalting unit feed stream 324 before being introduced into high lift solvent deasphalting unit 720. The second portion of the hydrocracking bleed stream 311B, such as from greater than 0 wt % to about 20 wt %, may pass to the bitumen blowing unit 740 for further processing. The second portion of the hydrocracking bleed stream 311B may be combined with other streams into bitumen blowing unit feed stream 344 before being introduced into the bitumen blowing unit 740.

In the configuration of system 300, a number of streams combine to become the high lift solvent deasphalting unit feed stream 224. In system 300, the first portion of the vacuum residue stream 303A may be combined with the first portion of the hydrocracking bleed stream 311A to form high lift solvent deasphalting unit feed stream 324. The system 300 may be configured such that the high lift solvent deasphalting unit is fed with a combination of vacuum residuum and recycled material from hydrocracking unit.

The high lift solvent deasphalting unit may be considered the "unit of last resort" in system 300 to recycle useful fluid products back into the system 300 and other units. That is, the bottoms product from this unit is passed for conversion in the bitumen blowing process. The system 300 may be configured such that the high lift solvent deasphalting unit feed stream 324 may be introduced into high lift solvent deasphalting unit 720. The system 300 may be configured such that the high lift solvent deasphalting unit 720 may be processed with the combination of vacuum residue and unconverted oil, in the presence of a butane solvent, into asphaltene lean and rich products. The solvent (butane) to oil (vacuum residue and unconverted oil) ratio may be in a range of about 5:1 in one or more embodiments.

The system 300 may be combined such that the high lift solvent deasphalting unit 720 may produce two products from the conversion of the high lift solvent deasphalting unit feed stream, both of which are provided to other units for additional processing. An asphaltene-lean heavy deasphalted oil stream 325 may be produced as the light product. The asphaltene-lean heavy deasphalted oil stream 325 may be split between a first portion of the asphaltene-lean heavy deasphalted oil stream 325A and a second portion of the asphaltene-lean heavy deasphalted oil stream 325B. The first portion of the asphaltene-lean heavy deasphalted oil stream may be from about 50 wt % to about 80 wt % of the asphaltene-lean heavy deasphalted oil stream, such as from about 50 wt % to about 70 wt %, or from about 50 wt % to about 60 wt %. The second portion of the asphaltene-lean heavy deasphalted oil stream 325B may be from about 20 wt % to about 50 wt %, such as from about 30 wt % to about 50 wt %, or from about 40 wt % to about 50 wt %. The split between the first and second portion may vary within these ranges given the desired amount of lube oil to be produced. The first portion of the asphaltene-lean heavy deasphalted oil stream 325A may be directed to the low lift solvent deasphalting unit 730 for conversion. The second portion of the asphaltene-lean heavy deasphalted oil stream 325B may be combined with heavy oil stream 337 to form the hydrotreating feed stream 353. An asphaltene-rich pitch stream 326 may also be formed as the bottoms product. The asphaltene-rich pitch stream 326 may be directed towards the bitumen blowing unit 740 for conversion.

As previously described, in system 300 the configuration the first portion of the asphaltene-lean heavy deasphalted oil stream 325A may be introduced into the low lift solvent deasphalting unit 730. The low lift solvent deasphalting unit 730 is configured to combine the second portion of the vacuum residue feed stream is combined with a propane stream (as a solvent, not shown) and then to separate the second portion of the vacuum residue feed stream into two products. The ratio of solvent to vacuum residue feed may be in a ratio of about 8:1 in one or more embodiments.

The system 300 is configured such that the low lift solvent deasphalting unit 730 may produce two product streams: a light deasphalted oil product stream 336, which passes from the system 300 as a product, and a heavy oil stream 337 that may pass from the bottom as a reject stream. The produced light deasphalted oil is a lube base feed stock.

In the configuration of system 300, a number of streams may combine to become the bitumen blowing unit feed stream 344. The second portion of the vacuum residue stream 303B is combined with the asphaltene-rich pitch stream 326 from the high lift solvent deasphalting unit 720 and with the second portion of the hydrocracking bleed stream 311B. In addition, the low viscosity gas oil feed stream also is introduced into the system 300 and may also be combined with the three other streams to form the bitumen blowing unit feed stream 344.

The system 300 is configured such that the bitumen blowing unit feed stream 344 may be introduced into the bitumen blowing unit 740 and converted into a bitumen and asphalt product. The bitumen and asphalt may be a road grade product. The bitumen and asphalt product may be passed from bitumen blowing unit 740 and system 300 via bitumen and asphalt stream 345.

Process Method to use System

In one or more embodiments, processes may include introducing a feed into a system, such as those systems described in FIGS. 1-3. The processes may also include operating the system such that fractionating, solvent stage deasphalting, hydrocracking, hydrotreating, bitumen blowing, pitch pelletizing, or a combination thereof produce one or more system products from the introduced feed.

The system products that may be produced from one or more embodiments of the process include high value fuels and feedstocks, including, but not limited to, diesel, gasoline, and naphtha; lube base feed stock; and olefins, including, but not limited to, ethylene, propylene, and butene. The products produced by the system will be further described.

The process may be used for multiple bottom upgrading projects in semi-conversion or hydro skimming refineries.

The process includes introducing a feed into a system of one or more embodiments. The feed may be a straight run vacuum residue, a cracked feed stock, or both a straight run and a cracked feed stock. The feed is introduced into the vacuum column.

When introducing cracked feedstock, the process may produce lube base feedstock in a limited manner but may also produce high value fuels and core building block petrochemicals. To produce lube base feedstock, the cracked feedstock component in the feed is 15% or less, such as less than 15%, 10% or less, or 5% or less.

Operating the system includes fractionating the input stream. Fractionating includes separating the introduced feed by boiling point in a vacuum column. The vacuum column may be a vacuum distillation column.

For example, fractionating includes operating the system such that a distillate, a gas oil, and a vacuum residue are produced. The distillate may boil at or below about 370° C. The gas oil may boil between about 370-560° C. The vacuum residue may boil above about 560° C. The fractionating step may also include combining the fractionated distillate and gas oil products into a single internal stream, such as in a distillate and vacuum gas oil stream (vacuum column lights stream).

Operating the system may include passing fractionated products (vacuum residue) to both a solvent deasphalting unit and a hydrocracking unit. When a bitumen blowing unit is included in the system, operating the system may include passing the fractionated product (vacuum residue) to the bitumen blowing unit.

In one or more embodiments, when the system includes a catalytic cracking unit instead of a hydrocracking unit, operating the system may include passing fractionated product to a solvent deasphalting unit and a catalytic cracking unit.

Solvent stage deasphalting may include operating the system such that a combined internal stream of vacuum residue and unconverted oil (reject stream from a hydrocracking unit) are deasphalted in a high-lift solvent deasphalting unit in one or more embodiments. The combined internal stream may further include a heavy oil, such as the bottoms product from a low lift solvent deasphalting unit. The high lift solvent stage deasphalting produces two products: an asphaltene-lean heavy deasphalted oil and an asphaltene-rich pitch.

Solvent stage deasphalting may include operating the system such that a vacuum residue is passed into and is deasphalted in a low-lift solvent deasphalting unit.

Solvent stage deasphalting may include operating the system such that an asphaltene-lean heavy deasphalted oil is passed into and further deasphalted in a low-lift solvent deasphalting unit.

The low lift solvent stage deasphalting may produce two products: a light deasphalted oil and a heavy oil stream (that may include asphaltene). The light deasphalted oil is a system product that may be a useful lube base feed stock.

In one or more embodiments, operating the system may include producing naphtha and an unconverted oil from the hydrocracking unit. The system may operate under a "naphtha mode," where the unit produces naphtha and an unconverted oil from the hydrocracking unit and where light ends production may be as high as 15-20% of the feed to the hydrocracking unit.

In one or more embodiments, a system is configured where a catalytic cracking unit is utilized instead of a hydrocracking unit. In one or more embodiments, the process may include introducing a vacuum residue stream into a catalytic cracking unit and operating the system such that the vacuum residue stream is catalytically cracked. The vacuum residue stream in one or more embodiments may comprise a vacuum residue and an asphaltene-lean heavy deasphalted oil. The system operation may produce multiple products from the catalytic cracking unit. The products are the same type of boiling products as products from the hydrocracking unit, except the products from the catalytic cracking unit are more olefinic and aromatic as compared to products from the hydrocracking unit. As such, products from a catalytic cracking unit may be used for other purposes than products from a hydrocracking unit.

pitch, an unconverted oil rejected material or recycle stream from hydrocracking unit, and a low viscosity gas oil (having a viscosity in a range of from about 800 to 1200 cSt). The system operation may produce bitumen and asphalt from the bitumen blowing unit. The bitumen and asphalt is a system product that comprises road grade asphalt. When a catalytic cracking unit is included instead of a hydrocracking unit, slurry oil from the catalytic cracking unit is directed to the bitumen blowing unit.

In one or more embodiments, the process may include introducing an asphaltene-rich pitch into a pitch pelletizing unit and operating the system such that the asphaltene-rich pitch is processed in the pitch pelletizing unit. The system operation may produce a solid fuel as a system product. The solid fuel comprises pelletized or flaked pitch.

Examples

Example 1 is described in Table 1, showing a flow scheme that is an example of a high-level balance using the system and process according to one or more embodiments, for example in conjunction with FIG. 1 (parallel solvent deasphalting residuum upgrading complex with bitumen production).

TABLE 1

Flow scheme results with parallel solvent deasphalting residuum upgrading complex with bitumen production (FIG. 1).

| Description | Unit | 101 | 102A | 102B | 102 | 103 | 103A | 103B | 124 | 125 | 136 | 137 |
|---|---|---|---|---|---|---|---|---|---|---|---|---|
| Rate | TPH | 100 | 26.8 | 32.9 | 59.7 | 40.3 | 20 | 15.3 | 25.4 | 16.5 | 1.60 | 3.40 |
| Density | g/mL | 0.97 | 0.91 | 0.91 | 0.93 | 2478 | 2478 | 2478 | 1.02 | 0.98 | 0.95 | 1.07 |
| Sulfur | wt % | 3.25 | 2.33 | 2.33 | 2.59 | 4.23 | 4.23 | 4.23 | 4.01 | 3.26 | 2.33 | 5.05 |
| CCR | wt % | 9.04 | — | — | 0.74 | 21.4 | 21.4 | 21.4 | 20.6 | 7.20 | 3.53 | 28.9 |
| Metal | ppmw | 29.8 | — | — | 0.21 | 73.7 | 73.7 | 73.7 | 68.3 | 7.80 | 1.46 | 99.1 |
| Asphaltene | wt % | 2.06 | — | — | 0 | 7.61 | 7.61 | 7.61 | 7.05 | 0.05 | 0.05 | 10.8 |
| Viscosity | cSt (100° C.) | 35.8 | — | 14.9 | 7.84 | 2478 | 2478 | 2478 | 2159 | >140 | 23 | 117711 |
| Penetration | dmm | — | — | — | — | — | — | — | — | — | — | — |

| Description | Unit | 113 | 115 | 116 | 117 | 111 | 111B | 111A | 126 | 11B | 144 | 145 |
|---|---|---|---|---|---|---|---|---|---|---|---|---|
| Rate | TPH | 72.2 | 2.31 | 2.74 | 69.3 | 2.46 | 0.46 | 2.00 | 8.89 | 4.00 | 28.7 | 28.2 |
| Density | g/mL | 0.94 | 0.83 | 0.83 | 0.83 | 0.83 | 0.83 | 0.83 | 1.11 | 0.91 | 1.02 | — |
| Sulfur | wt % | 2.70 | — | — | — | — | — | — | 5.50 | 2.33 | 4.15 | — |
| CCR | wt % | 2.30 | — | — | — | — | — | — | 40.0 | 0 | 22.3 | — |
| Metal | ppmw | 2.00 | — | — | — | — | — | — | 151 | — | — | — |
| Asphaltene | wt % | — | — | — | — | — | — | — | 17.6 | — | — | — |
| Viscosity | cSt (100° C.) | 15.0 | 23.0 | 23.0 | 23.0 | 23.0 | 23.0 | 23.0 | $20.1 \times 10^6$ | 4.07 | 1000 | — |
| Penetration | dmm | — | — | — | — | — | — | — | — | — | — | 60-70 |

In Table 1, "g/mL" is grams per milliliter, "wt %" is weight percent (w/w), "ppmw" is part-per-million by weight. "cSt" is centistokes, and "dmm" is tenths of a millimeter (referring to the depth needle penetration into surface of penetration grade bitumen in a penetration test).

In one or more embodiments, the process may include introducing a hydrotreating feed stream into a hydrotreating reactor and operating the system such that the hydrotreating feed stream is hydrotreated. The hydrotreating stream in one or more embodiments may comprise an asphaltene-lean heavy deasphalted oil and a heavy oil stream from a low lift solvent deasphalting unit. A hydrogen stream is directed to the hydrotreating reactor. The system operation may produce two products from the hydrotreating reactor. The products may include a light ends product, which is a system product, and a hydrotreated light ends product.

In one or more embodiments, the process may include introducing a bitumen blowing unit feed stream into a bitumen blowing unit and operating the system such that bitumen blowing unit feed stream is processed in the bitumen blowing unit. The bitumen blowing unit feed stream may be comprised of a vacuum residue, an asphaltene-rich In Example 1, when the input stream 101 (FIG. 1, feed) is 100 TPH, the asphalt stream 145 (FIG. 1, bitumen residue lift) is 28.2 (about 28 wt %) and the products produced (other than asphalt or bitumen) are 71.78 (72 wt %) of the total feed (from the input stream). Further, the total 28.7 TPH of bitumen blowing unit feed stream 144 (FIG. 1) includes about 53 wt % vacuum residue (15.3 TPH), about 31 wt % pitch (8.89 TPH), about 2 wt % unconverted oil (0.46 TPH), and about 14 wt % gas oil (4 TPH).

In Example 1 (FIG. 1), a distillate stream 102A boiling below about 370° C. and a vacuum gas oil stream 102B boiling between about 370° C. and about 560° C. combine to form the vacuum column light stream 102.

In Example 1, the first portion of the vacuum residue stream 103A is 50 wt %, the second portion of the vacuum residue stream 103B is 12 wt %, and the remaining portion of the vacuum residue stream 103C is 38 wt % of the overall weight of the vacuum residue stream 103 (100 wt %); the first portion of the hydrocracking bleed stream 111A is 81 wt % and the second portion of the hydrocracking bleed stream 111B is 19 wt % of the overall weight of the hydrocracking bleed stream 111 (100 wt %).

Advantageous Effects

The system and process of one or more embodiments have several attributes useful to the global refining industry. One or more embodiments of the present disclosure may provide one or more of the following advantages.

In one or more embodiments, a mixture of vacuum residue and pitch (produced in a solvent deasphalting unit) is converted into a system product. For example, bitumen and asphalt may be produced comprising a road grade asphalt.

In one or more embodiments, cascading solvent deasphalting units are utilized in closed couple operation with hydrocracking units. Such a configuration maximizes conversion. Meaning, 60% of the residue may be converted to lighter products when bitumen is also produced, and if no bitumen is produced then a conversion may reach 80% (pitch production case). "Cascading" as used herein is how the residue flows in a cascade from one solvent deasphalting unit to the next, with different lifts, thus rejecting heavy molecules out of the cascade and containing the molecules that are processed or sent as final products.

In one or more embodiments, hydrocracking and solvent deasphalting close-coupled operation allows rejection of heavy polynuclear aromatics. Rejection of heavy polynuclear aromatics and subsequent recycling ensures high conversion of heavy stocks compared to processing in a hydrocracking unit alone. "High conversion" means that the hydrocracking unit may convert in excess of 90% of the feed to products boiling at temperatures below 370° C.; nominal conversion in the hydrocracking unit may be greater than 90%, such as 91%, 92%, 93%, 94%, 95%, 96%, 97%, or 98%.

In one or more embodiments, high value fuels, lube base stock feed, and petrochemical building blocks are produced as system products. Without wanting to be bound by theory, when a conventional system is used that differs from the flow scheme (system) of one or more embodiments, the conventional system may produce high value fuels but at a higher cost that is not economically viable compared to the flow scheme of one or more embodiments.

In one or more embodiments, operating the system includes high conversion of both straight run vacuum residue or cracked stock (residuum) to produce both fuels and lube.

In one or more embodiments, an ability to reject heavy polynuclear aromatics across the solvent deasphalting system allows for high hydrocracking unit conversion and to produce bitumen when allowed.

Definitions

The term "stream" may include various hydrocarbons, such as straight chain, branched, or cyclical alkanes, alkenes, alkadienes, alkynes, aromatics, and other substances such as gases and impurities. A stream may include a combination of aromatic and nonaromatic compounds.

The term "zone" can refer to an area including one or more equipment items or one or more sub-zones. Equipment items include one or more reactors or reactor vessels, heaters, exchangers, pipes, pumps, compressors and controllers. Additionally, an equipment item, such as reactor dryer or vessels, can further include one or more zones.

The term "true boiling point" means a boiling point of a material defined by ASTM D2892. ASTM D2892 is a test method for determining the boiling point of a material, for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

The term "white oil" means a hydrocarbon product that has a true boiling point (end point) below about 370° C. These may include, but are not limited to, hydrocarbons in liquefied petroleum gas, and naphtha and distillate range.

The term "distillate" means a hydrocarbon that has a true boiling point range between 150-370° C. This may include, but is not limited to, kerosene and diesel product.

The term "residuum" means a hydrocarbon that has a true boiling point above 370° C. and is the feed to the vacuum distillation column The term "gas oil" means a hydrocarbon that has a true boiling point range between 370-560° C. This may include, but is not limited to, gas oil derived as side cuts from a vacuum distillation column in the fractionation section.

The term "vacuum residuum" (or "vacuum residue") means hydrocarbon that has a true boiling point above 560° C. and is derived as a bottom stream after flashing the lighter components from a fuel oil stream.

The term "pitch" is the asphaltene-rich stream from a high lift solvent deasphalting unit.

The term "asphaltene" can mean a heavy polar fraction and is the residue that remains after the resins and oils have been separated from the feed residue fed to a solvent deasphalting unit. One or more embodiments of Conradson carbon and metals (contaminants) are described with a hydrogen to carbon atomic ratio (H/C) and concentrations of metals and other components, to be described. Asphaltene from vacuum residue is generally characterized as having a Conradson or Ramsbottom carbon residue of 15 to 90 weight % and a hydrogen to carbon (H/C) atomic mass ratio of 0.5 to 1.5 (mass ratio). Asphaltene may contain from 50 ppm to over 5000 ppm vanadium and from 20 ppm to over 2000 ppm nickel. The sulfur concentration of asphaltene may be in a range of from 110 wt % to 350 wt % greater than the concentration of sulfur in the vacuum residue oil feed oil to the deasphalting unit. The nitrogen concentration of asphaltene can be from 100 wt % to 350 wt % greater than the concentration of nitrogen in the residue oil feed oil to the deasphalting unit.

The term "resin oil" means an aromatic polar fraction that is an intermediate between the de-asphalted oil and asphaltene (pitch) separated from the feed residue to a deasphalting unit. Resins may be denser or heavier than deasphalted oil, but lighter than asphaltene. The resin product may comprise aromatic hydrocarbons with aliphatic substituted side chains, and may also comprise metals, such as nickel and vanadium.

The term "deasphalted oil" is generally the least dense product produced in a deasphalting unit and comprises saturated aliphatic, alicyclic, and some aromatic hydrocarbons. Deasphalted oil may comprise less than 30 wt % aromatic carbon and relatively low levels of heteroatoms less than 10% except sulfur, such as less than 10 wt % heteroatoms. Deasphalted oil from vacuum residue can be generally characterized as follows: a Conradson or Ramsbottom carbon residue of 1 to less than 12 weight % and a hydrogen to carbon (H/C) atomic mass ratio of 1.0 to 2 (mass ratio). Deasphalted oil may contain 100 ppm or less, such as 5 ppm or less, less than 5 ppm, 2 ppm or less, or less than 2 ppm, of vanadium. Deasphalted oil may contain 100 ppm or less, such as 5 ppm or less, less than 5 ppm, 2 ppm or less, or less than 2 ppm of nickel. The sulfur and nitrogen concentrations of deasphalted oil can be 90 wt % or less of the sulfur and nitrogen concentrations of the residue oil feed oil to the de-asphalting unit.

The term "heavy deasphalted oil" means a mixture of resin and deasphalted oil that is usually produced from a solvent deasphalting unit using a heavy solvent (butane or heavier molecular weight hydrocarbons) when the lift (amount of deasphalted oil produced) is above 60% (as a weight basis of the vacuum residue feed).

The term "light deasphalted oil" means a deasphalted oil that is usually produced from a solvent deasphalting unit using a light solvent (such as propane) when the lift (amount of deasphalted oil produced) is below 40% (as a weight basis of the feed to the solvent deasphalting unit).

The term "hydrocracking unit" is a fixed bed catalytic process unit used to convert distillate, gas oil range and deasphalted oil to white oil products either maximizing naphtha or ultra-low sulfur diesel. The hydrocracking process is carried out in a reaction temperature range 360° C. to 420° C. and a reaction pressure in the range of from 70 bara to 170 bara (hydrogen partial pressure). The conversion in the hydrocracking zone may be in the range of 50-98%; the liquid hourly space velocity 0.5-3 reciprocal hours ($hr^{-1}$). In one or more embodiments, the conversion is expected to be around 95% with a two-stage unit configuration. The catalyst in the hydrocracking unit is a heterogeneous fixed bed catalyst that includes one or more Group VIII metal, and one or more Group VIB metal. The Group VIII metal is one or more selected from the group consisting of iron, cobalt, and nickel. The Group VIB metal is one or more selected from the group consisting of molybdenum and tungsten. The Group VIII metal may be present in the amount of about 2-20% by weight, and the Group VIB metal may be present in the amount of about 1-25% by weight. Generally, these metals are included on a support material, such as silica, alumina, or combination thereof. Additional acidity in the form of zeolites may be present for a hydrocracking catalyst or a promoter such as Group XV oxides. Group XV oxides may be present for the residue conversion and hydrotreating catalysts. In one or more embodiments, the hydrocracking unit is a two-stage hydrocracking configuration. This may aid in conversion efficiency and feed quality.

The term "solvent deasphalting unit" is a liquid-liquid extraction unit utilizing $C_3/C_4/C_5$ solvent producing a deasphalted oil and a resin (if produced) lighter cut from the vacuum residuum or a heavy feed with the asphaltene rejected in the pitch stream, as an asphaltene-rich pitch stream. The solvent to oil ratio in the solvent deasphalting unit is between 3:1 to 8:1 with operation of the solvent deasphalting unit being either under subcritical or super critical pressure and temperature range of the solvent being used. The lift (production of deasphalted oil and resin, if produced) is in the range of 30 wt % to 80 wt % of the (residuum) feed; optimally below 70 wt %.

The term "pitch pelletizing unit" is a unit where pitch from a solvent deasphalting unit is pelletized or flaked to produce a solid material that may be used as fuel for combustion or gasification.

The term "vacuum column" is a vacuum distillation column that processes atmospheric residue (hydrocarbons boiling above 370° C. from a crude distillation unit) operating at a pressure below atmosphere (usually in the range of about 25 millimeters of mercury (mmHg) to about 100 mmHg at the flash zone at an operating temperature of about 300° C. to about 500° C. in the flash zone) producing gas oil products (boiling less than 560° C. and a residue boiling greater than 560° C.).

Major liquid product fluid coupling has been shown in one or more embodiments, and other streams (hydrocarbon and otherwise with the process flow scheme) have not been shown in one or more embodiments, and their inclusion can be understood by one of ordinary skill in the art.

The term "major" can mean an amount of about 50%, such as about 80%, by weight of a compound or class of compounds in a stream.

The term "substantially" can mean an amount of about 80%, such as about 90%, or about 99%, by mole, of a compound or class of compounds in a stream.

As used here and in the appended claims, the words "comprise," "has," and "include" and grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to ±10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it should be understood that another one or more embodiments is from the one particular value to the other particular value, along with all particular values and combinations thereof within the range.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open-ended phrase to introduce a recitation of a series of elements, components, materials, or steps should be interpreted to also disclose recitation of the series of elements, components, materials, or steps using the closed terms "consisting of" and "consisting essentially of" For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of." The words "comprise," "has," and "include" and grammatical variations thereof are each intended to have an open, non-limiting meaning that does not exclude additional elements or steps.

While one or more embodiments of the present disclosure have been described with respect to a limited number of embodiments, those skilled in the art, having benefit of this disclosure, will appreciate that other embodiments can be devised, which do not depart from the scope of the disclosure. Accordingly, the scope of the disclosure should be limited only by the attached claims.

What is claimed is:

1. A system to upgrade an input stream, comprising:

a vacuum column;

a hydrocracking unit coupled downstream of and in fluid communication with the vacuum column;

a high lift solvent deasphalting unit coupled downstream of and in fluid communication with the vacuum column;

a low lift solvent deasphalting unit coupled downstream of and in fluid communication with the vacuum column; and a bitumen blowing unit coupled downstream of and in fluid communication with the vacuum column and the high lift solvent deasphalting unit, where: the vacuum column is configured to receive an input stream of a straight run atmospheric residue or a cracked feedstock and to separate the input stream into a vacuum column light stream and a vacuum residue stream, the hydrocracking unit is configured to receive a combined stream of the vacuum column light stream and a heavy deasphalted oil stream, as well as a hydrogen stream, and to pass a distillate and naphtha product, and a light ends product, the heavy deasphalted oil stream is in fluid communication with the hydrocracking unit and also with the high lift solvent deasphalting unit, the high lift solvent deasphalting unit is configured to receive a butane stream, as well as a combined stream of a first portion of the vacuum residue stream, a first portion of a hydrocracking bleed stream, and a heavy oil stream, and to pass an asphaltene-lean heavy deasphalted oil stream and an asphaltene-rich pitch stream, an unconverted oil stream is in fluid communication with the hydrocracking unit, the high lift solvent deasphalting unit, and the bitumen blowing unit, the low lift solvent deasphalting unit is configured to receive a propane stream, as well as a second portion of the vacuum residue stream, and to pass a light deasphalted oil that is a lube base feed stock, and a heavy oil stream, the heavy oil stream is in fluid communication with the high lift solvent deasphalting unit, the bitumen blowing unit is configured to receive a combined stream of a second portion of the hydrocracking bleed stream, a remaining portion of the vacuum residue stream, and a low viscosity gas oil stream, and to pass a bitumen and asphalt stream, the low viscosity gas oil stream is in fluid communication with the bitumen blowing unit, and the vacuum residue stream is in parallel to the high lift solvent deasphalting unit, the low lift solvent deasphalting unit, and the bitumen blowing unit.

2. The system of claim 1, where the first portion of the vacuum residue stream is in a range of from about 40 wt % to about 60 wt % of the vacuum residue stream.

3. The system of claim 1, where the first portion of the hydrocracking bleed stream is in a range of from about 80 wt % to 100 wt % of the unconverted oil stream.

4. The system of claim 1, where the second portion of the vacuum residue stream is in a range of from about 5 wt % to about 15 wt % of the vacuum residue stream.

5. The system of claim 1, where the second portion of the hydrocracking bleed stream is in a range of from greater than 0 wt % to about 20 wt % of the unconverted oil stream.

6. The system of claim 1, where the remaining portion of the vacuum residue stream is from about 25 wt % to about 45 wt % of the vacuum residue stream.

7. The system of claim 1, where the vacuum column light stream comprises hydrocarbons that boil at a temperature at or less than 560° C., and the vacuum residue stream comprises hydrocarbons that boil at a temperature above 560° C.

8. The system of claim 1, where the combined stream of the vacuum residue stream, the unconverted oil stream, and the heavy oil stream form a combined vacuum residue, unconverted oil, and heavy oil, and where the high lift solvent deasphalting unit is further configured to receive a ratio of about 5:1 of butane to the combined vacuum residue, unconverted oil, and heavy oil.

9. The system of claim 1, where the low lift solvent deasphalting unit is further configured to receive a ratio of about 8:1 of propane to vacuum residue.

10. The system of claim 1, where the low viscosity gas oil stream has a viscosity of from 800 to 1200 centistokes.

11. A system to upgrade an input stream, comprising:

an input stream of a straight run atmospheric residue or a cracked feedstock;

a vacuum column;

a hydrocracking unit coupled downstream of and in fluid communication with the vacuum column;

a high lift solvent deasphalting unit coupled downstream of and in fluid communication with the vacuum column;

a low lift solvent deasphalting unit coupled downstream of and in fluid communication with the vacuum column; and a pitch pelletizing unit coupled downstream of and in fluid communication with the high lift solvent deasphalting unit, where:

the vacuum column is configured to receive the input stream and to separate the input stream into a vacuum column light stream and a vacuum residue stream, the hydrocracking unit is configured to receive a combined stream of the vacuum column light stream and a heavy deasphalted oil stream, as well as a hydrogen stream, and to pass a distillate and naphtha product, and a light ends product, the heavy deasphalted oil stream is in fluid communication with the hydrocracking unit and also with the high lift solvent deasphalting unit, the high lift solvent deasphalting unit is configured to receive a butane stream, as well as a combined stream of a first portion of the vacuum residue stream, an unconverted oil stream as a hydrocracking bleed stream, and a heavy oil stream, and to pass an asphaltene-lean heavy deasphalted oil stream and an asphaltene-rich pitch stream, the unconverted oil stream is in fluid communication with the hydrocracking unit and the high lift solvent deasphalting unit, the low lift solvent deasphalting unit is configured to receive a propane stream, as well as a combined stream of a second portion of the vacuum residue stream, and to pass a light deasphalted oil that is a lube base feed stock, and a heavy oil stream, the heavy oil stream is in fluid communication with the high lift solvent deasphalting unit, the pitch pelletizing unit is configured to receive an asphaltene-rich pitch stream, and to pass a solid fuel, the asphaltene-rich pitch stream is in fluid communication with the high lift solvent deasphalting unit and the pitch pelletizing unit, and the vacuum residue stream is in parallel to the high lift solvent deasphalting unit and the low lift solvent deasphalting unit.

12. The system of claim 11, where the first portion of the vacuum residue stream is from about 70 wt % to about 90 wt % of the vacuum residue stream.

13. The system of claim 11, where the second portion of the vacuum residue stream is from about 10 wt % to about 30 wt % of the vacuum residue stream.

14. The system of claim 11, where the vacuum column light stream comprises hydrocarbons that boil at a temperature at or less than 560° C., and the vacuum residue stream comprises hydrocarbons that boil at a temperature above 560° C.

15. The system of claim 11, where the combined stream of the vacuum residue stream, the unconverted oil stream, and the heavy oil stream form a combined vacuum residue, unconverted oil, and heavy oil, and where the high lift solvent deasphalting unit is further configured to receive a ratio of about 5:1 of butane to the combined vacuum residue, unconverted oil, and heavy oil.

16. The system of claim 11, where the low lift solvent deasphalting unit is further configured to receive a ratio of about 8:1 of propane to vacuum residue.

17. A system to upgrade an input stream, comprising:

an input stream of a straight run atmospheric residue or a cracked feedstock;

a vacuum column;

a hydrocracking unit coupled downstream of and in fluid communication with the vacuum column;

a high lift solvent deasphalting unit coupled downstream of and in fluid communication with the vacuum column;

a low lift solvent deasphalting unit coupled downstream of and in fluid communication with the high lift solvent deasphalting unit;

a hydrotreating reactor coupled downstream of and in fluid communication with the high lift solvent deasphalting unit and the low lift solvent deasphalting unit; and a bitumen blowing unit coupled downstream of and in fluid communication with the vacuum column and the high lift solvent deasphalting unit, where:

the vacuum column is configured to receive the input stream and to separate the input stream into a vacuum column light stream and a vacuum residue stream the hydrocracking unit is configured to receive a hydrogen stream, as well as a combined stream of the vacuum column light stream and an effluent from the hydrotreating reactor, and to pass a distillate and naphtha product, and a light ends product, the effluent from the hydrotreating reactor is in fluid communication with the hydrocracking unit as an effluent hydrocracking feed stream, and is also in fluid communication with the hydrotreating reactor, the high lift solvent deasphalting unit is configured to receive a butane stream, as well as a combined stream of a first portion of the vacuum residue stream, and a first portion of a hydrocracking bleed stream, and to pass an asphaltene-lean heavy deasphalted oil stream and an asphaltene-rich pitch stream, an unconverted oil stream is in fluid communication with the hydrocracking unit, the high lift solvent deasphalting unit, and the bitumen blowing unit, the low lift solvent deasphalting unit is configured to receive a propane stream, as well as a first portion of the asphaltene-lean heavy deasphalted oil stream, and to pass a light deasphalted oil that is a lube base feed stock, and a heavy oil stream, the heavy oil stream is in fluid communication with the hydrotreating reactor, the hydrotreating reactor is configured to receive a hydrogen stream, as well as a combined stream of a second portion of the asphaltene-lean heavy deasphalted oil stream, and the heavy oil stream, and to pass a light ends product, the bitumen blowing unit is configured to receive a combined stream of a second portion of the hydrocracking bleed stream, a second portion of the vacuum residue stream, the asphaltene-rich pitch stream, and a low viscosity gas oil stream, and to pass a bitumen and asphalt stream, the low viscosity gas oil stream is in fluid communication with the bitumen blowing unit, and the vacuum residue stream is in parallel to the high lift solvent deasphalting unit and the bitumen blowing unit.

18. The system of claim 17, where the first portion of the vacuum residue stream is from about 50 wt % to about 80 wt % of the vacuum residue stream.

19. The system of claim 17, where the first portion of the hydrocracking bleed stream is from about 80 wt % to 100 wt % of an unconverted oil stream.

20. The system of claim 17, where the first portion of the asphaltene-lean heavy deasphalted oil stream is from about 50 wt % to about 80 wt % of an asphaltene-lean heavy deasphalted oil stream.

21. The system of claim 17, where the second portion of the asphaltene-lean heavy deasphalted oil stream is from about 20 wt % to about 50 wt % of the asphaltene-lean heavy deasphalted oil stream.

22. The system of claim 17, where the second portion of the hydrocracking bleed stream is from greater than 0 wt % to about 20 wt % the unconverted oil stream.

23. The system of claim 17, where the second portion of the vacuum residue stream is from about 20 wt % to about 50 wt % of the vacuum residue stream.

24. The system of claim 17, where the vacuum column light stream comprises hydrocarbons that boil at a temperature at or less than 560° C., and the vacuum residue stream comprises hydrocarbons that boil at a temperature above 560° C.

25. The system of claim 17, where the high lift solvent deasphalting unit is further configured to receive a ratio of about 5:1 of butane to combined vacuum residue and unconverted oil.

26. The system of claim 17, where the low lift solvent deasphalting unit is further configured to receive a ratio of about 8:1 of propane to vacuum residue.

27. The system of claim 17, where the low viscosity gas oil stream has a viscosity of from 800 to 1200 centistokes.

28. A process, comprising:

introducing a straight run atmospheric residue or a cracked feed stock into a system; and operating the system including a step of fractionating, a step of solvent stage deasphalting, and a step of hydrocracking, where the step of fractionating includes operating the system such that a fractionated distillate, a gas oil product, and a vacuum residue are produced from a vacuum column with an input of the straight run atmospheric residue or the cracked feed stock, and combining the fractionated distillate and the gas oil product into a single internal stream as a vacuum column lights stream, where the step of solvent stage deasphalting includes operating the system such that an asphaltene-lean heavy deasphalted oil and an asphaltene-rich pitch are produced from a high-lift solvent deasphalting unit with an input of a combined internal stream of vacuum residue and unconverted oil, where the step of solvent stage deasphalting further includes operating the system such that a light deasphalted oil, which is a lube base feed stock, and a heavy oil are produced from a low-lift solvent deasphalting unit with an input of vacuum residue or an asphaltene-lean heavy deasphalted oil, and where the step of hydrocracking includes operating the system such that a naphtha product and an unconverted oil are produced from a hydrocracking unit with an input of a combined internal stream of a vacuum residue and an asphaltene-lean heavy deasphalted oil.

29. The process of claim 28, where the step of hydrocracking further includes operating the system such that a combined distillate and naphtha product, a light ends product, and an unconverted oil are produced from the hydrocracking unit.

30. The process of claim 28, where the combined internal stream of vacuum residue and unconverted oil further includes a heavy oil.

31. The process of claim 28, further comprising operating the system with a step of bitumen blowing, comprising:

operating the system such that a bitumen and asphalt product is produced comprising a road grade asphalt from a bitumen blowing unit with an input of a combined internal stream of a vacuum residue, an asphaltene-rich pitch, an unconverted oil, and a low viscosity gas oil.

32. The process of claim 28, further comprising operating the system with a step of hydrotreating, comprising:

operating the system such that a light ends product and a hydrotreated light ends product are produced from a hydrotreating reactor with an input of a combined internal stream of an asphaltene-lean heavy deasphalted oil and a heavy oil.

33. The process of claim 28, further comprising operating the system with a step of pitch pelletizing, comprising:

operating the system such that a solid fuel comprising a pelletized or flaked pitch is produced from an asphaltene-rich pitch.

* * * * *